United States Patent [19]

Sclippa

[11] 4,054,047

[45] Oct. 18, 1977

[54] DEVICE FOR RECEIVING AND DISCHARGING ROLLED BARS AND THE LIKE

[75] Inventor: Ferruccio Sclippa, Udine, Italy

[73] Assignee: Simac S.p.A., Udine, Italy

[21] Appl. No.: 732,147

[22] Filed: Oct. 13, 1976

[30] Foreign Application Priority Data

Oct. 13, 1975 Italy ..... 83459/75

[51] Int. Cl.[2] ..... B21B 43/08; B65G 29/00

[52] U.S. Cl. ..... 72/201; 198/450; 198/614; 214/1 P

[58] Field of Search ..... 72/200, 201, 202, 252; 214/1 P, 1 PB, DIG. 3, DIG. 4; 266/132, 133; 198/450, 614, 774

[56] References Cited

U.S. PATENT DOCUMENTS

| | | | |
|---|---|---|---|
| 890,250 | 6/1908 | Thompson | 266/133 |
| 3,497,084 | 2/1970 | Murrah | 214/1 P |
| 3,610,437 | 10/1971 | Barakov et al. | 214/1 P |

FOREIGN PATENT DOCUMENTS

| | | | |
|---|---|---|---|
| 1,316,672 | 12/1961 | France | 214/1 PB |
| 1,376,607 | 9/1964 | France | 214/1 P |
| 2,412,803 | 9/1975 | Germany | 72/201 |

*Primary Examiner*—E. M. Combs
*Attorney, Agent, or Firm*—Browdy and Neimark

[57] ABSTRACT

A discharge device for the reception in the axial direction of advancing rolled bars or the like and the discharge of same, this discharge device comprising essentially two rotating drums, opposed to another in a way so as to be rotated on parallel axles between them, substantially on the horizontal plane with an equal number of symmetric arrangements of external radial longitudinal grooves, which form external opposite channels suitable for the reception of the said bars, and in which in the longitudinal lateral opposite horizontal area of said rotating drums is juxtaposed a wall or shell to form a static containing case for the closing of the said channels in the restricted lateral area of each rotating drum, respectively in order to close said drums in the restricted area, wherein the closed channels in the cover section of the restricted area are to receive in opposition, respectively alternately the bars and by the way of the said drums, in order that said bars are respectively rotated into said channels, respectively alternately by the rotation of said drums respectively, in order to laterally translate said bars from the restricted area towards the bottom, and discharging the bar respectively alternately to the bottom into the cooling plate.

7 Claims, 4 Drawing Figures

DEVICE FOR RECEIVING AND DISCHARGING ROLLED BARS AND THE LIKE

BACKGROUND OF THE INVENTION

1. Field of the Invention

The object of the present invention is a discharge-device with two rotating radial channel devices for the reception in the axial direction of bars coming from the rolling mill and the discharge of same to the cooling plant or to load the packing-machine in an arranged way and parallel one to each other.

This device is particularly useful as an essential element at the end of the cutting device for the bars, coming from the rolling mill or from the plant of continuous production, for the discharge of said bars by transverse translation in the cooling plate for instance those, which are characterized as "in the inlet plate" of the rolling plant.

2. Prior Art

At the present state of technique, different types of equipment are known, which are suitable to carry out the task of reception with an eventual precooling and the following discharge of the bars and products of lamination, generally with cooling plates and/or the like, or connected to same for the well known purpose (i.e., inlet plate).

A series of first equipments use one, two or more movable inclined planes, which generally are driven by eccentrics; these movable planes have walls or parapets, set at an angle in order, that with the alternate movement of said planes in a movable angle they will cause alternation of the channels for the reception of the bars and of the opening towards the downstream part of said channels for the lateral discharge of the bars.

A variance of the said equipment is obtained by using the inclined planes with movable parapets, which may carry out the same operations as the movable planes.

Even if these elements are notoriously and extensively tested and are found efficient, they present limitations, which are acquired by the speed limits, difficulty with efficient pre-cooling, absence of a guide for the bar at the time when the channel is closed, high cost of execution, and a complicated installation which results in well-known interventions for the maintenance.

Another series of equipment uses a pendulum system, which is characterized by a sort of swing device which has the shape of a swinging anchor, like a pendulum of predetermined periods, which forms at the righthand side and at the lefthand side of the said pendulum both channels for the reception and the discharge of the bars.

This equipment presents not only the disadvantage of the open guide, as mentioned before, but also the disadvantage of not being ready for the adjustment to the various steady speeds, and it remains the limit of the elevation, because of the remarkable masses in oscillation.

A third series of equipment have the same shape as the one mentioned before, which is to say, an anchor with inside cables. These devices are static and provided with lateral apertures for the communication of the inside cable; the bars will now be driven by way of a deviator on one side of the channel and then on the other (righthand side or lefthand side) and by way of alternately casting compressed air, the said bars will be alternately discharged sideward by using the side-apertures and at the same time a pre-cooling will be executed.

These devices have the advantage of being quite simple and not having any mechanical parts in movement. The state of pre-cooling and the speed, that can be achieved, are without doubt acceptable, but they present the disadvantage of guiding the channel with one open side, and the limitation of employing bars of limited sections.

Further types of equipment provide the employment of rotating drums, which have various longitudinal channels for the reception of the bar, which during rotation pick up the different bars in a progressive order of angular rotation, discharging them as well progressively toward the downstream part.

Even though the equipment reaches high speeds, they present always the disadvantage of guiding in the open, without considering the determining difficulty, which exists for the exact synchronisation of the receiving channel with the channel; that is to discharge the bar at the exact moment, at which the latter is tossed in its own channel.

Another system in the prior art consists of channels or tube-containers with vertical dividing ribs and two sidewings, swinging oblique, which swinging generates longitudinal light for the discharge.

These systems bring the bar to a removal, when they are discharged to the cooling tables, which makes it complex to bring them to the point of the movement, that puts a layer of arranged shapes into effect.

SUMMARY OF THE INVENTION

The purpose of the present invention is to obviate the disadvantages of the discharge devices, well-known in the prior art, and to allow at the same time to achieve an extremely high speed.

The present invention consists practically of a double parallel rotating radial channel device as an oriented coplanar parallel opposed rotating couple of drums, each drum being peripherally equipped with radial longitudinal exterior opened channels, said channels being synchronized with the rotation of the opposed drums for receiving alternately the rolled bar, and where the discharge is effected by way of two containing cases, which serve also for the distribution, which conveys the bar to the pre-cooling table under the said opposed drums.

This is substantially obtained by essentially putting into action the distributor with two rotating drums, that rotate in opposite directions.

According to the present invention a first preferential embodiment of the device consists of two rotaing drums, which have close to them, divided by a static separation wall; which extends from one side to the other of same, with the rotating channels of two opposed drums, channels which are set very close to each other, or even adjoining one another, and inside which the said channels move constantly toward the bottom, according to synchronized controls.

Since these drums with their relative channels are arranged substantially on parallel horizontal axles, which are rotating in opposite directions, so that the opposed adjoining channels assume a descending movement, the frontal distributor makes the righthand side drum move anticlockwise and the left one move clockwise.

In this way there is put into action the concentration of the bars instead of their divarication, and if so desired, also their exit-divarication. Consequently the bars will be tossed into the inside channels, and in the alternate opposition, instead on the outside of the rotating drums.

A second embodiment of the device consists of the same two drums, wherein they have opposite exterior curved walls or shells, which close said channels in the said rotating drums opposed external portion of the area, so that the frontal distributor makes the righthand side drum move clockwise and the left one will move anticlockwise. In this way there is put into action the divarication of the bars instead of their concentration and makes a further divarication impossible, instead in exit there is an exit-concentration possible.

DETAILED DESCRIPTION OF THE PREFERRED EMBODIMENT

The present invention however, will be better understood with the help of the enclosed drawings, wherein an embodiment is illustrated in a simplified preferential way, but not in a limiting way.

In the drawings

Figures 1, 2:
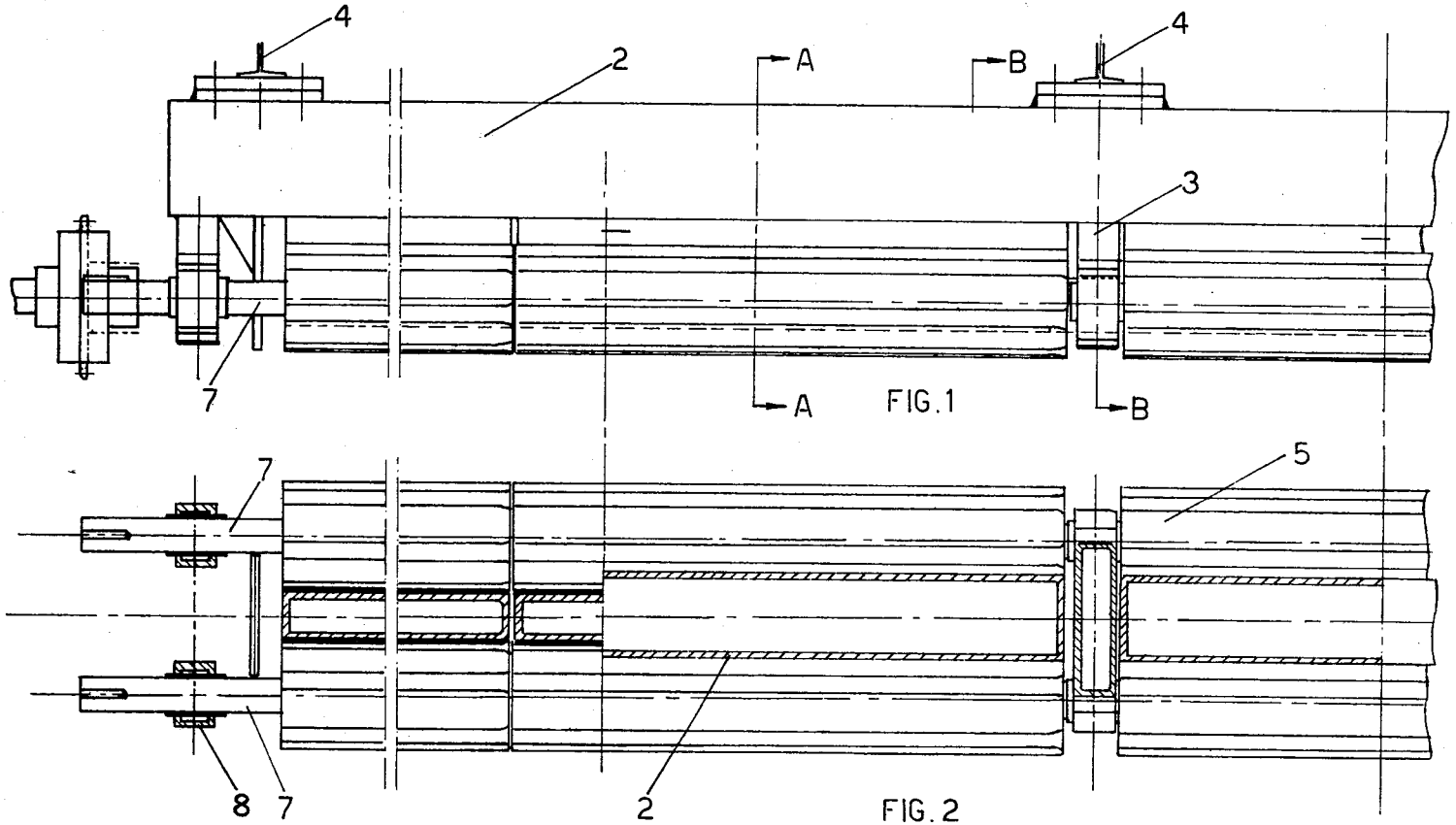
FIG. 1 is a schematic partial side elevational view of the distributor device.
FIG. 2 is a top plan view of the device of FIG. 1 with a partial axle in cross section.
Figure 4:
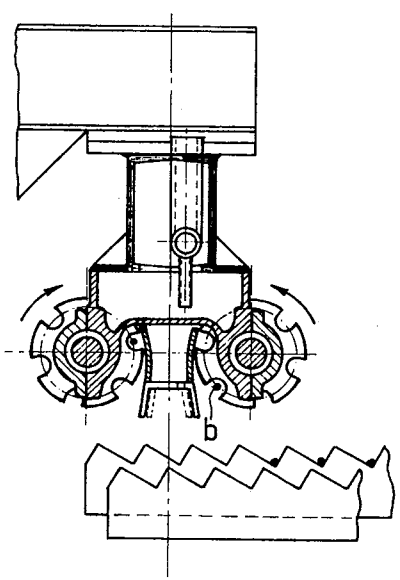
FIG. 4 is a partial view in transverse cross section which corresponds with the support between the channel-sets, taken along the line B—B of FIG. 1.
Figure 3:
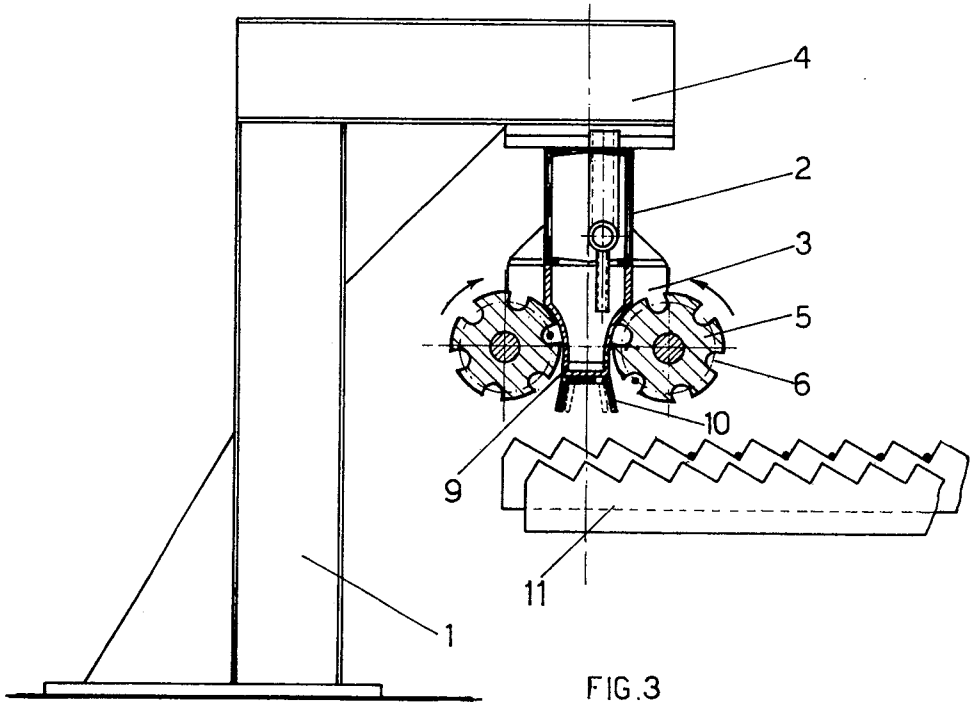
FIG. 3 is a partial view in transverse cross section taken along the line A—A of FIG. 1.

According to the schematic figures the machine consists of a series of support-posts 1, which are anchored in the floor, of a super-normal overhanging beam-frame 4, that bears a longitudinal beam 2, to which the rotating drums 5 are anchored with supporting arms 3. To these drums are peripherally obtained the opened channels 6, which rotate with them; these channels are longitudinal external grooves in the drums and are intended for the reception of the bars.

The drums with rotating channels are formed of a few parts, however, attached onto two axles 7, which are put into rotation by well known means and mounted loosely to support 8.

The distance between the two drums is so, that the wheelbases of the two opposite grooves or channels, are equal to the wheelbases between the exit of the deviator, which is situated in the shears and directly upstream.

Between these drums, corresponding to the operation arch are two containing cases or shells 9, which form a closed space, wherein a cooling liquid may run. Below these walls and/or containing cases are lower extensions 10 provided to orientate the bar during its discharge. This orientation means 10 accomplishes the definitive position of the bar on the plate for the cooling or for translation 11. Naturally, the cases or walls 9 may be situated more or less close one to each other, or may also be put together into a single dividing wall, (not illustrated).

The device operates as follows: Each drum 5 according to the specific requirements bears a series *n* of longitudinal grooves or channels 6. One of these grooves or channels is situated corresponding with the exit of the deviator at a suitable transmission, and successively imposes with each load of bars a drum rotation of a fraction of a turn equal to 1/n alternately one to each other respectively.

Through the effect of the deviator, which is placed upstream of the device, the bar *b* arrives alternately at the channel of the right drum or the left one or vice versa, in the operating restricted area of the operation arch.

At the end of each operation, by way of special driving devices, the drum concerned is rotated for the mentioned fraction of a turn, to prepare itself automatically for the following receiving action in the free channel.

At the same time as the rotation of the first drum is put into effect the loading of the opposite channel, which is situated at the second drum, followed by its rotation, when the deviator sends the bar into the free channel of the opposite drum and so on.

The phase of discharging the bar will depend on the number of grooves on each drum and on the extent of protection from the inner containing wall, and therefore may take place with the first or the following rotation.

On account of its synchronized operation, the machine will not have dead times, due to the discharge which is the consequence of the rotation.

The locationing of the bar may be adjusted by way of the displacement of the symmetric or asymmetric extension, which are situated centrally or inside downstream in the containing case.

The cycle may proceed interminably by way of micro-switches or other well-known detectors, to give the necessary consent to the regular prosecution of the cycle itself. It is obvious, that the present invention may be used for any type of shape or laminated bars of any wanted section or form and the illustrated preferencial execution is not limited, since there could be other forms and methods of execution, however, without leaving the essence of the present invention.

I claim:

1. A discharge device for reception in the axial direction of rolled bars and the like and transverse discharge of same, the device comprising, in combination:

a first and a second rotatable drum positioned in close vicinity to one another, each said drum being provided with an equal number of symmetrical, external, longitudinal grooves which are to receive respective ones of the bars and the like;

a pair of axles for rotating said rotatable drums in opposite directions;

a wall means positioned between said drums, said wall means including two, outwardly facing, respective curved surfaces adjacent respective said drums and forming therewith respective transfer paths and transfer pockets for bars and the like which are to be moved while positioned in said grooves as these grooves move past said curved surfaces;

means for driving said axles in opposite directions of rotation;

deviating means for delivering alternatingly individual bars and the like to said first drum and to said second drum; and means beneath said drums for receiving bars and the like alternately discharged one at a time from said first drum and said second drum.

2. A device according to claim 1, wherein said means for driving said axles comprise means for driving said axles in synchronized alternate steps, one of said drums being in motion while the other of said drums is stationary for receiving a bar and the like to be discharged.

3. A device according to claim 2, wherein each said drum has *n* of said grooves therein and said means for driving said axles effect alternate rotation of said drums in 1/n steps.

4. A device according to claim 1, including means for synchronizing said deviating means with said means for driving said axles in steps.

5. A device according to claim 1, wherein said wall means with said grooves form moving transfer pockets for the protection of bars and the like and define a respective restricted lateral area of each said rotating drum respectively to close said grooves as they pass through this restricted area.

6. A discharge device according to claim 5, wherein said wall means is hollow and forms a central axial closed space defining a refrigerating chamber which is to contain a cooling liqid.

7. A device according to claim 1, wherein said wall means includes two downwardly pointing portions from respective said curved surfaces for orienting bars and the like during their fall from said grooves toward said means for receiving.

* * * * *